US012722243B2

(12) United States Patent
Wember et al.

(10) Patent No.: US 12,722,243 B2
(45) Date of Patent: Sep. 1, 2026

(54) GRINDING MACHINE AND METHOD OF OPERATING A GRINDING MACHINE

(71) Applicant: ADELBERT HAAS GMBH, Trossingen (DE)

(72) Inventors: Dirk Wember, Rottweil (DE); Thomas Bader, Gosheim (DE); Reinhard Endres, Peissenberg (DE); Gerhard Schnee, Denkingen (DE)

(73) Assignee: ADELBERT HAAS GMBH, Trossingen (DE)

( * ) Notice: Subject to any disclaimer, the term of this patent is extended or adjusted under 35 U.S.C. 154(b) by 482 days.

(21) Appl. No.: 18/197,953

(22) Filed: May 16, 2023

(65) Prior Publication Data

US 2023/0373054 A1 Nov. 23, 2023

(30) Foreign Application Priority Data

May 17, 2022 (DE) ..... 102022112353.7

(51) Int. Cl.
*B24B 27/00* (2006.01)
*B24B 41/00* (2006.01)
(Continued)

(52) U.S. Cl.
CPC ..... *B24B 27/0069* (2013.01); *B24B 41/005* (2013.01); *B24B 41/04* (2013.01); *B24B 41/06* (2013.01)

(58) Field of Classification Search
CPC .. B24B 27/0061; B24B 47/22; B23Q 3/15706
See application file for complete search history.

(56) References Cited

U.S. PATENT DOCUMENTS 3,300,856 A * 1/1967 Daugherty ..... B23Q 3/15773 483/63
4,173,817 A * 11/1979 Voglrieder ..... B23Q 3/15706 409/225

(Continued)

FOREIGN PATENT DOCUMENTS

DE 3831082 A1 3/1990
DE 19844242 C2 9/2000

(Continued)

OTHER PUBLICATIONS

Office action of parallel pending European patent application No. 23 173 301.5 issued Oct. 9, 2023.

(Continued)

*Primary Examiner* — Joel D Crandall
(74) *Attorney, Agent, or Firm* — Nath, Goldberg & Meyer; Jerald L. Meyer; Morgan D. Rosenberg

(57) ABSTRACT

A grinding machine includes a machine bed on which a workpiece spindle with a workpiece holder and a tool spindle with a tool holder are arranged. A workpiece held in the workpiece spindle, relative to a tool held in the tool holder, is displaceable along an X-axis running in a first direction parallel to the surface of the machine bed, is displaceable along a Y-axis, running in a second direction parallel to the surface of the machine bed, is displaceable along a Z-axis running perpendicular to the surface of the machine bed, is rotatable about an A-axis running parallel to the surface of the machine bed, and is rotatable about a C-axis running perpendicular to the surface of the machine bed. The tool spindle is completely kinematically separated from the workpiece spindle. Movements along the X-axis, about the A-axis and about the C-axis being carried out by the workpiece spindle.

12 Claims, 2 Drawing Sheets

Figure 1:
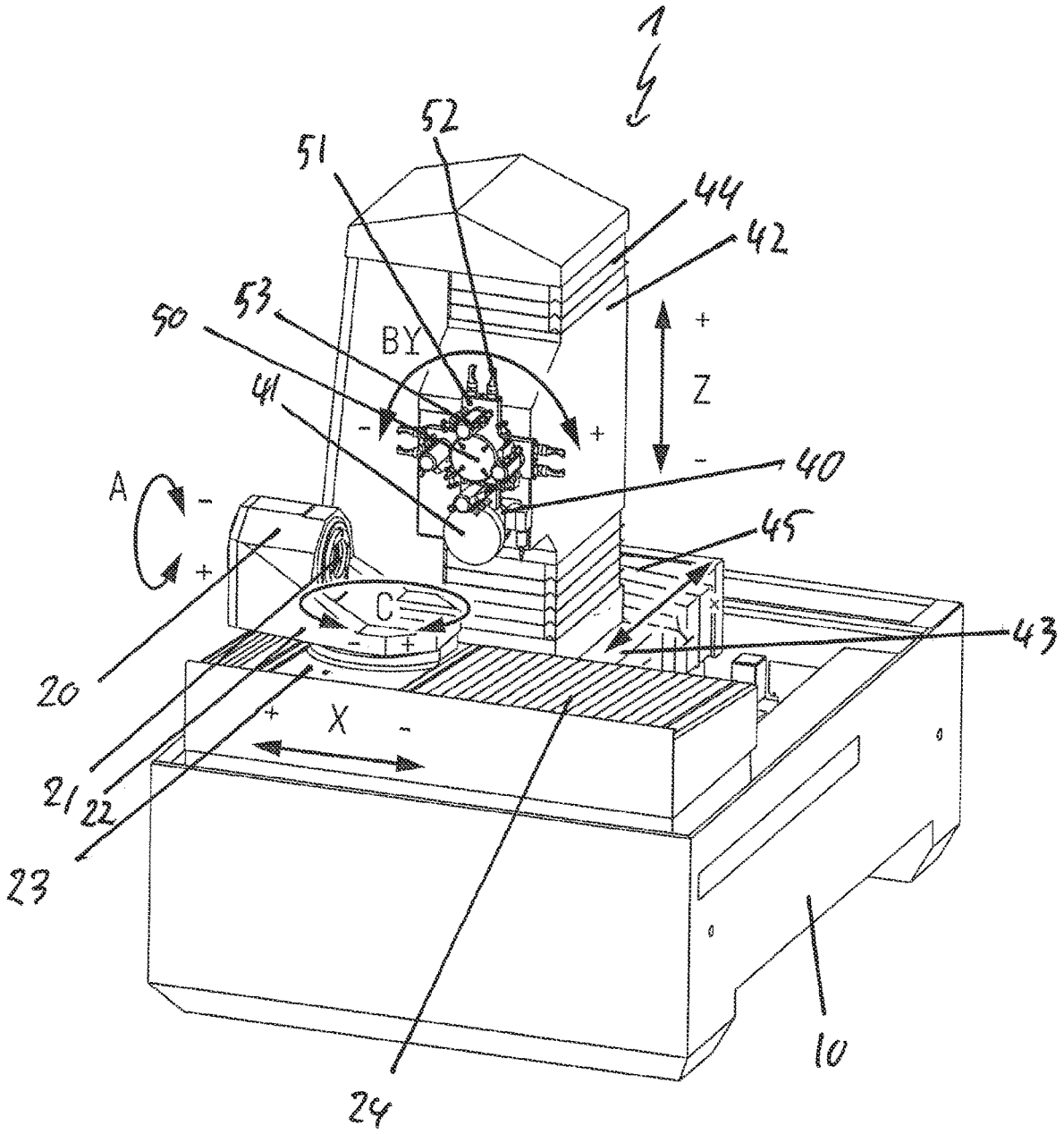

(51) Int. Cl.
*B24B 41/04* (2006.01)
*B24B 41/06* (2012.01)

(56) References Cited

U.S. PATENT DOCUMENTS

| | | | | | |
|---|---|---|---|---|---|
| 4,482,043 | A * | 11/1984 | Bauman | B23Q 7/1431 | 29/33 P |
| 4,590,662 | A * | 5/1986 | Norota | B23Q 3/15713 | 211/1.52 |
| 5,359,814 | A * | 11/1994 | Baltazar | B24D 7/16 | 451/449 |
| 5,681,209 | A * | 10/1997 | Naumann | B24D 7/18 | 451/52 |
| 2020/0164476 | A1* | 5/2020 | Li | B23Q 3/15722 | |

FOREIGN PATENT DOCUMENTS

| | | | |
|---|---|---|---|
| DE | 102012002982 | B4 | 8/2013 |
| DE | 102019120681 | A1 | 2/2021 |
| EP | 0611630 | B1 | 8/1994 |
| EP | 0816012 | A1 | 1/1998 |
| EP | 2567783 | A1 | 3/2013 |
| EP | 3208035 | A1 | 8/2017 |
| EP | 3308904 | A1 | 4/2018 |

OTHER PUBLICATIONS

Office Action issued Apr. 12, 2023, in corresponding German patent application No. 102022112353.7.
European Search Report dated Mar. 18, 2026 corresponding to application No. 23 173 301.5-1103.

* cited by examiner

GRINDING MACHINE AND METHOD OF OPERATING A GRINDING MACHINE

The invention relates to a grinding machine with the features of the preamble of claim 1, and a method of operating such a grinding machine.

Grinding machines, such as those known from EP 2915622 B1, enable workpieces to be machined, characterized in that complex surface geometries can be produced with great precision. Precisely because this high-precision production takes up a not inconsiderable amount of processing time in many cases anyway, it is of particular importance to achieve the highest possible throughput of workpieces in order to be able to manufacture cost-effectively and profitably.

The object of the invention is to provide a grinding machine and a method of operating a grinding machine that allow the throughput that can be achieved with the grinding machine to be increased.

This object is achieved by a grinding machine with the features of claim 1 and a method of operating a grinding machine with the features of claim 12. Advantageous refinements of the invention are the subject matter of the respective dependent claims.

The grinding machine according to the invention has a machine bed on which a workpiece spindle with a workpiece holder and a tool spindle with a tool holder are arranged in such a way that a workpiece held in the workpiece spindle, relative to a grinding tool held in the tool holder which grinding tool can be formed in particular by a grinding wheel pack, is

- displaceable along an X-axis, which is an axis running in a first direction parallel to the surface of the machine bed,
- displaceable along a Y-axis, which is an axis running in a second direction parallel to the surface of the machine bed,
- displaceable along a Z-axis, which is an axis running perpendicular to the surface of the machine bed,
- rotatable about an A-axis, which is an axis running parallel to the surface of the machine bed, and
- rotatable about a C-axis, which is an axis running perpendicular to the surface of the machine bed.

It is essential to the invention that the tool spindle is completely kinematically separated from the workpiece spindle, with movements along the X-axis, about the A-axis and about the C-axis being carried out by the workpiece spindle (whose axis of rotation is usually predefined by the A-axis or forms the A-axis) and movements along the Y-axis and along the Z-axis being carried out by the tool spindle.

As a result, this type of kinematic separation not only allows to improve the precision of the positioning, because an arrangement with three linear axes built onto one another is avoided, but also allows the workpiece and tool to be changed at the same time, so that the workpiece throughput that is achievable with the grinding machine can be increased because the movement necessary for the tool change or for the workpiece change to the change positions to be approached by the tool spindle or workpiece spindle can be carried out simultaneously.

It is particularly preferred in this case that the grinding machine has a tool changer. Such a tool changer allows a tool change to be carried out without having to reach into the work area of the machine from outside, which further increases the achievable workpiece throughput.

If a tool changer is present, there are advantages in terms of machining time if the tool changer can be moved together with the tool spindle, regardless of whether there is a kinematic separation and how the individual degrees of freedom of movement of the relative movement between the workpiece spindle and the tool spindle are divided; that is to say, in the case of the kinematic separation explained above, the tool changer can be moved along the Y-axis and/or along the Z-axis. This means that only very small travel distances from the grinding position to the changing position are needed, which contributes to a quick tool change and thus improves the achievable workpiece throughput.

It is particularly preferred in this case if the tool changer is rotatable about a BY-axis, which is an axis running parallel to the tool spindle, and is displaceable in the direction along the BY-axis, in particular parallel to the Y-axis. With such a configuration, a tool arranged on the tool spindle can simply be gripped by closing a gripper which is opened during operation of the tool spindle and which is otherwise already in the correct position. After the spindle clamp has been released, the tool can be lifted by moving it parallel to the BY-axis, the new tool can be brought into position by rotating the tool changer about the BY-axis, the new tool can be inserted into the tool spindle by moving it parallel to the BY-axis, the spindle clamp can be tensioned and the gripper can be opened. In particular, this can reduce the necessary travel distance for the tool change to the distance that is necessary to ensure that the tool does not collide with the workpiece when it is lifted.

In particular when the tool changer is moved together with the tool spindle, it is advantageous if the tool changer has at least one coolant distributor for cooling a tool held by the tool spindle, and advantageously has a separate coolant distributor for each tool present on the tool changer. In this way, the coolant and lubricant flow can be very easily adapted to the tool used during grinding.

In a refinement of this embodiment, it is provided that coolant distributors are detachably arranged on the tool changer, so that a coolant distributor can be individually replaced depending on the tool that is inserted in the respective holding position of the tool changer, in order to allow for optimal cooling and lubrication in each case. In this case, it is advantageous if the tool changer also has a sensor for monitoring whether a coolant distributor is properly arranged on the tool changer.

Advantageously, the coolant distributors are assigned to a respective tool in that the coolant distributor is rotated along with the tool during a rotation about the BY-axis.

In particularly preferred embodiments of the grinding machine, the X-axis and the Y-axis are driven with linear motors. This achieves a very fast, powerful but at the same time highly precise controllable movement along these axes, so that the time for the precise movement on the axis to a target point can be minimized.

It is also advantageous if a separate pneumatic valve terminal is assigned to the tool spindle and the workpiece spindle, because this allows the clamping and unclamping processes in the tool or workpiece holder of the respective spindle to be carried out particularly quickly.

If the A-axis or the workpiece spindle providing it is combined with a T-slot table to form a single unit, one degree of freedom is eliminated when aligning the workpiece spindle, which leads to an increase in the achievable precision and can reduce differences between workpieces produced on different copies of the grinding machines that are the subject of the invention.

The cabin, which is generally present in grinding machines and defines a machine interior, is preferably arranged on the machine bed and advantageously has corner doors, which can be opened and closed in a particularly preferably synchronously controlled manner. This enables particularly good access to the machine interior from several directions.

The operating parameters of the grinding machine can be set particularly well if a maintenance plate is arranged on the back of the grinding machine, on which manometers, regulators and/or filters are arranged.

If cable ducts and lines for grounding, lubrication, motor cooling and/or process cooling are integrated into the machine bed, they are optimally protected when the grinding machine is in operation; in addition, the cleaning of the work area in which the grinding process takes place is simplified.

A particularly high degree of precision in the guidance of individual components of the grinding machine can be achieved if all the guide supports of the machine bed are in one plane.

Integrated level monitoring for the machine bed ensures that the machine is not flooded with coolant and lubricant (e.g. due to a blockage in the return line).

It can help to level the grinding machine if the machine bed has and stands on three machine feet.

A particularly effective sealing between a cabin placed on the machine bed and the environment can be achieved if the machine bed has a peripheral edge for sealing the machine bed and the cabin.

If the grinding machine has a robot, which can be embodied in particular as a robot arm, for changing the workpiece, the time needed for this process can be significantly reduced. It is advantageous in this case if the robot is arranged outside the work area in an automation cabin which can, however, be opened in particular in the direction of the work area or machine interior, and that the workpiece spindle can be moved into the automation cabin on the X-axis, so that the robot arm does not have to reach into the work area when changing workpieces. This not only protects the robot arm, but also allows the new workpiece to be picked up by a quick and highly precise movement of the workpiece spindle in the x-direction.

For this purpose, it can be particularly useful if the X-axis is extended. This can be achieved in a particularly advantageous manner by arranging an add-on module on the machine bed, which extends the X-axis and carries the automation cabin.

If there is a robot, it makes sense if there is a palletizing system from which the robot can take workpiece blanks and into which the robot can deposit finished workpieces.

In the inventive method of operating a grinding machine according to the invention, workpieces clamped successively at the workpiece spindle are machined with one or more grinding tools clamped at the tool spindle. According to the invention, to carry out a workpiece change and/or to carry out a tool change, the workpiece spindle and/or the tool spindle are moved kinematically decoupled from one another, which makes it possible to move both the workpiece spindle and the tool spindle simultaneously to their respective set-up position at which they are loaded or their loading is adjusted.

It is particularly preferred in this case if workpieces are changed with a robot that is arranged outside the work area in an automation cabin, in that the workpiece spindle with the clamping system that forms the workpiece holder and the workpiece is moved into the automation cabin along the X-axis. Especially when using linear motors and a direct position measurement system, this is faster and also more precise than moving the robot, which is also protected in this way.

In particular, the robot and the work piece spindle can be pre-positioned so that to specify the machined work piece and/or to take over the new work piece, in particular as a blank, only a movement along the X-axis has to be carried out, so that the work piece spindle with the clamping system forming the workpiece holder, and the workpiece can be moved into the automation cabin immediately after machining. In this case, before reaching the automation cabin, the A-axis can be aligned parallel or at a defined angle to the X-axis by rotating it about the C-axis.

Because the control of the X-axis works with high precision and with greater precision than that of the robot, it is particularly advantageous if, when picking up the next workpiece to be machined, the movement needed for removing the workpiece from the clamping system that forms the workpiece holder of the workpiece spindle, and/or for inserting the next workpiece into the clamping system that forms the workpiece holder of the workpiece spindle, in the direction of the X-axis takes place by displacing the workpiece spindle along the X-axis, in particular after the robot has assumed the correct position relative to the X-axis.

A particularly time-efficient tool change is possible if the following steps are carried out when changing tools with a tool changer:

gripping the grinding wheel holder,
releasing the spindle clamp,
lifting the tool by moving it parallel to the BY-axis,
rotating the tool changer about the BY-axis,
inserting the new tool by moving it parallel to the BY-axis,
tightening the spindle clamp,
opening the gripper The invention is explained in more detail below with reference to figures that represent exemplary embodiments.

Figure 2:
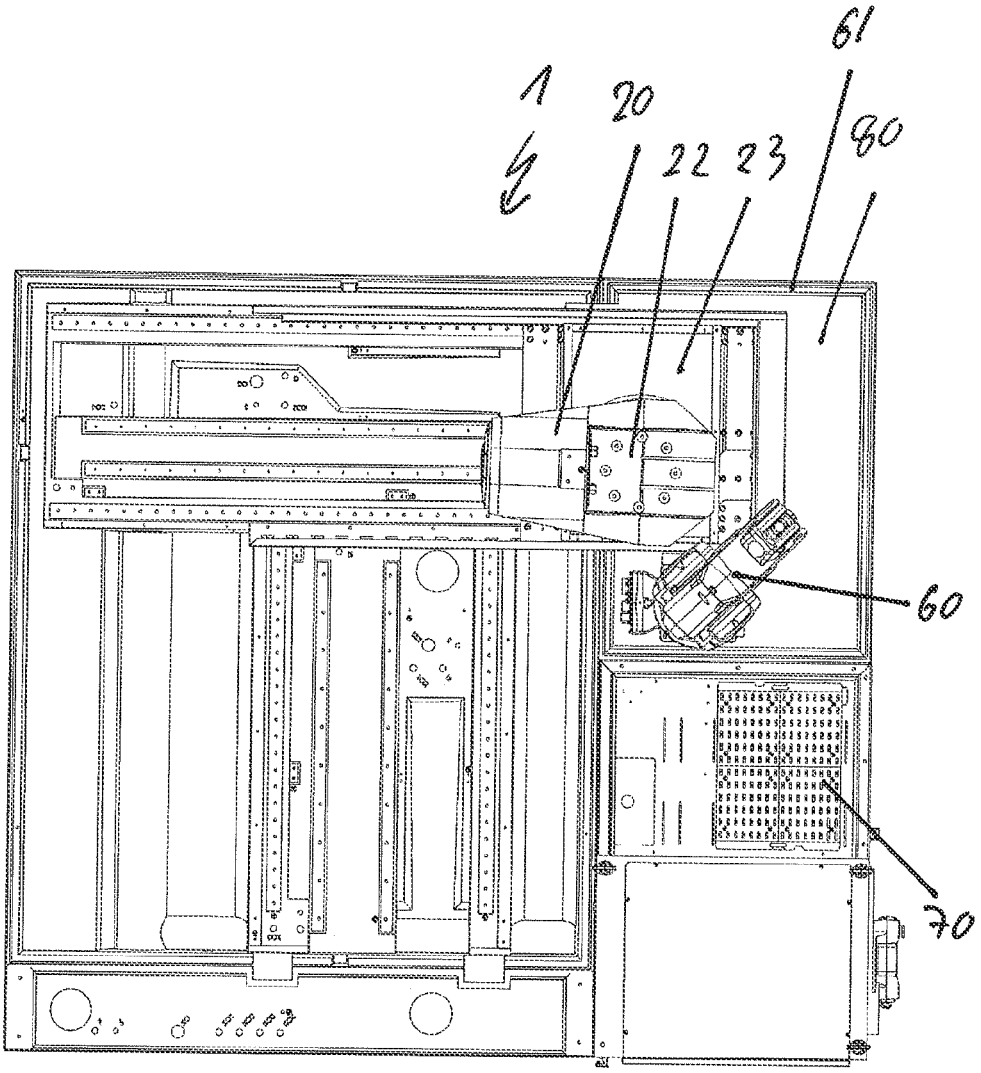

In the figures:

FIG. 1 shows a view of an exemplary embodiment of a grinding machine with the cabin removed, and FIG. 2 shows a top view of components of the grinding machine of FIG. 1 in combination with an optional automation by a robot and a palletizing system FIG. 1 shows an exemplary embodiment of a grinding machine 1 in which the cabin has been omitted for an unobstructed view of the work area of the grinding machine 1. Also not shown in FIG. 1 is a modular automation and palletizing system that can optionally be added to grinding machine 1 and is included in FIG. 2.

A machine bed 10, which is manufactured for the benefit of high accuracy in molding technology using mineral casting for improved vibration damping, carries workpiece spindle 20 and tool spindle 40.

Furthermore, machine bed 10 has integrated cable ducts, a gravity-driven drain with an outlet where an optional screen is placed, for coolant and lubricant, integrated pipes for lubrication, motor cooling, process cooling and grounding, and integrated level monitoring, which are not visible in the representation of FIG. 1 because they are covered by other components.

Workpiece spindle 20, whose workpiece holder 21, shown in FIG. 1 without a workpiece held therein, defines the horizontally running A-axis of grinding machine 1, is integrated in a T-slot table 22 which is displaceable horizontally along the X-axis and can be rotated about the vertically running C-axis on a carriage 23. Carriage 23 runs on rails which are arranged on machine bed 10 and which, like the linear motor which drives carriage 23 and the direct, absolute measuring system which monitors its position, are located under cover 24 and are therefore not visible in FIG. 1.

Tool spindle 40, which is shown in the representation of FIG. 1 with a tool 41 in the form of a grinding wheel pack held therein, is carried by a carriage 42 which is displaceable along the Z-axis in the vertical direction on a rail system arranged vertically on a further carriage 43, which rail system defines said vertical Z-axis, and which, like the drive and the position monitoring of carriage 41, is not visible because it is located under cover 44.

Further carriage 43 in turn runs on rails which are arranged on machine bed 10, and which, like the linear motor which drives further carriage 43 and the direct, absolute measuring system which monitors its position, are located under cover 45 in FIG. 1, and are therefore not visible. These rails define the Y-axis, which runs perpendicular to the X-axis and is also horizontal.

Accordingly, it is clearly apparent that in the case of grinding machine 1, tool spindle 20 is completely kinematically separated from workpiece spindle 40, with movements along the X-axis, about the A-axis and about the C-axis being carried out by workpiece spindle 20 and movements along the Y-axis and along the Z-axis being carried out by tool spindle 40.

Carriage 42 also carries a tool changer 50, which in this case is designed for a total of four tools, of which only tool 41 held by the tool spindle 40 at this time, is shown in FIG. 1 in order to show the setup of tool changer 50 in the figure in more detail.

Tool changer 50, which is, as a result, moved together with the tool spindle in the direction of the Y-axis and in the direction of the Z-axis, has a carrier plate 51 with four arms of equal length arranged in the shape of a cross, at the end of which a gripper 52 is arranged, which gripper, in the equipped state, carries a tool 41, in particular a grinding wheel pack. The carrier plate is rotatable about a driven BY-axis running parallel to the Y-axis; moreover, it can be moved in a direction parallel to this axis in the direction towards the viewer in FIG. 1.

This allows tool 41 held by tool spindle 40 during grinding to be gripped with associated gripper 52 when a tool change is necessary, and to lift it parallel to the BY-axis by a linear movement, which in FIG. 1 runs towards the viewer, after the spindle clamp has been released. Thereafter, the tool changer can be rotated, for example, 90° so that the next tool held by gripper 52 of the next arm is positioned to be inserted parallel to the BY-axis into the tool holder of tool spindle 40 by linear motion, which in FIG. 1 is in the direction away from the viewer, to activate the spindle clamp and then release it with gripper 52 in order to be able to continue machining. During processing, this gripper 52 thus remains in a position in which it only has to be closed the next time the tool is changed in order to grip tool 41 to be changed. In this way, a very quick tool change is possible because only minimal travel distances have to be covered.

Another special feature of tool changer 50, which is shown in FIG. 1, is the replaceable coolant distributors 53 associated with each of the arms and grippers 52, respectively. As can be seen in FIG. 1, coolant distributor 53 of each tool 41 held in tool spindle 40 is aligned in such a way that the coolant and lubricant needed can be sprayed directly to the desired location during the grinding process. Because coolant distributors 53 are replaceable, a coolant distributor 53 optimized for the grinding process with this tool can be set up directly even when tool changer 50 is equipped with different tools 41, together with each tool 41, which leads to a considerable improvement in cooling and lubrication. Advantageously, a sensor is provided on tool changer 50 in each case, which monitors whether an associated coolant distributor 53 is present and properly connected or not.

FIG. 2 shows a top view of components of grinding machine 1 of FIG. 1 in combination with an optional automation by a robot 60 and a palletizing system 70. Here, the entire setup that carries tool spindle 40 and the tool changer, as well as covers 24, 44 and 45 have been omitted so that additional detail of the machine bed, particularly the rails defining the X-axis and Y-axis, can be seen.

As can be seen in FIG. 2, robot 60 embodied as a robot arm is arranged in an automation cabin 61 which is open to the machine interior, which at this point is not delimited by a section of a cabin wall. Automation cabin 61 and robot 60 are carried in this case by an add-on module 80 arranged on machine bed 10, which add-on module 80 extends the X-axis, and the rail system that defines it, respectively, as can be deduced from the position of workpiece spindle 20 shown in the workpiece changing position and the T-slot table 22 carrying it, and carriage 23.

Palletizing system 70 is located on the side of the robot 60 opposite T-slot table 22. Accordingly, robot 60 can deposit machined workpieces in palletizing system 70 with a simple pivoting movement, grip a new workpiece blank to continue machining and feed it to the workpiece spindle 20 without reaching into the machine interior or the work area. It is particularly advantageous if the movement of robot 60 is designed in such a way that robot 60 is pre-positioned with its workpiece gripper in such a way that, when the finished workpiece is transferred, carriage 23 moves a section of the workpiece still held in workpiece holder 21 into the opened workpiece gripper of robot 60, which then grips it before it is released and when the next workpiece blank is transferred to workpiece spindle 20, carriage 23 moves a section of the workpiece still held in the workpiece gripper of robot 60 into open workpiece holder 21 of workpiece spindle 20, which then fixes it with an expansion chuck, for example, before the workpiece gripper of robot 60 lets go. Since the movement of carriage 23 along the X-axis is faster and more precisely controlled than that of robot 60, time is not only saved, but transfer errors are also effectively avoided.

LIST OF REFERENCE NUMERALS

1 grinding machine
10 machine bed
20 workpiece spindle
21 workpiece holder
22 T-slot table
23 carriage
24 cover
40 tool spindle
41 tool
42 carriage
43 carriage
44 cover
45 cover
50 tool changer
51 carrier plate
52 gripper
53 coolant distributor
60 robot
61 automation cabin
70 palletizing system
80 add-on module

The invention claimed is:

1. A grinding machine (1), comprising:

a machine bed (10);

a workpiece spindle (20) arranged on the machine bed (10), the workpiece spindle (20) having a workpiece holder (21); and a tool spindle (40) arranged on the machine bed (10), the tool spindle (40) having a tool holder, wherein the workpiece spindle (20), the workpiece holder (21), the tool spindle (40) and the tool holder are each configured such that a workpiece held in the workpiece spindle (20), relative to a tool (41) held in the tool holder (40), is displaceable along an X-axis, the X-axis extending in a first direction parallel to a surface of the machine bed (10), the workpiece being displaceable along the X-axis by displacement of a T-slot table (22), the workpiece spindle (20) being carried by the T-slot table (22), wherein the workpiece spindle (20), the workpiece holder (21), the tool spindle (40) and the tool holder are each further configured such that the workpiece held in the workpiece spindle (20), relative to the tool (41) held in the tool holder (40), is displaceable along a Y-axis, the Y-axis extending in a second direction parallel to the surface of the machine bed (10), the tool (41) being displaceable along the Y-axis by displacement of the tool spindle (40) carried by a carriage (43), wherein the workpiece spindle (20), the workpiece holder (21), the tool spindle (40) and the tool holder are each further configured such that the workpiece held in the workpiece spindle (20), relative to the tool (41) held in the tool holder (40), is displaceable along a Z-axis, the Z-axis extending perpendicular to the surface of the machine bed (10), the tool (41) being displaceable along the Z-axis by displacement of the tool spindle (40) carried by a carriage (42), wherein the workpiece spindle (20), the workpiece holder (21), the tool spindle (40) and the tool holder are each further configured such that the workpiece held in the workpiece spindle (20), relative to the tool (41) held in the tool holder (40), is rotatable about an A-axis, the A-axis extending parallel to the surface of the machine bed (10), the workpiece spindle (20) rotating the workpiece about the A-axis, wherein the workpiece spindle (20), the workpiece holder (21), the tool spindle (40) and the tool holder are each further configured such that the workpiece held in the workpiece spindle (20), relative to the tool (41) held in the tool holder (40), is rotatable about a C-axis, the C-axis extending perpendicular to the surface of the machine bed (10), the workpiece spindle (20) being rotated about the C-axis by a carriage (23), wherein the tool spindle (40) is kinematically separated from the workpiece spindle (20), with movements along the X-axis, about the A-axis and about the C-axis being carried out by the workpiece spindle (20), and movements along the Y-axis and along the Z-axis being carried out by the tool spindle (40).

2. The grinding machine (1) according to claim 1, characterized in that the grinding machine (1) has a tool changer (50) which is moveable together with the tool spindle (40) along the Y-axis and along the Z-axis.

3. The grinding machine (1) according to claim 2, characterized in that the tool changer (50) is rotatable about a BY-axis, the BY-axis extending parallel to an axis of the tool spindle (40), the tool changer (50) being displaceable in a direction along the BY-axis.

4. The grinding machine (1) according to claim 2, characterized in that the tool changer (50) has at least one coolant distributor (53) for cooling a tool (41) held by the tool spindle (40).

5. The grinding machine (1) according to claim 4, characterized in that the at least one coolant distributor (53) is also rotated when rotating about a BY-axis, the BY-axis extending parallel to an axis of the tool spindle (40).

6. The grinding machine (1) according to claim 1, characterized in that the grinding machine (1) has a robot (60) for changing workpieces.

7. A method of operating the grinding machine (1) according to claim 1, comprising:

clamping workpieces successively at the workpiece spindle (20); and machining the successively clamped workpieces by grinding the workpieces with one or more tools (41) clamped at the tool spindle (40), wherein the workpiece spindle (20) and/or the tool spindle (40) are moved kinematically decoupled from one another to carry out a workpiece change and/or to carry out a tool change.

8. The method according to claim 7, characterized in that each of the workpieces is changed with a robot (60) arranged outside a work area in an automation cabin (61), wherein the workpiece spindle (20), the workpiece holder (21) thereof, and each of the workpieces are moved into the automation cabin (61) along the X-axis.

9. The method according to claim 8, characterized in that the robot (60) and the workpiece spindle (20) are pre-positioned and the workpiece spindle (20), the workpiece holder (21) thereof, and each of the workpieces are moved into the automation cabin (61) immediately after the machining.

10. The method according to claim 8, characterized in that the A-axis is aligned parallel to, or at a defined angle to, the X-axis by rotating about the C-axis before it reaches the automation cabin (61).

11. The method according to claim 8, characterized in that, when a subsequent one of the workpieces to be machined is picked up, movement in a direction of the X-axis needed for removing a previous one of the workpieces from the workpiece holder (21) of the workpiece spindle (20) and/or for inserting the subsequent one of the workpieces into the tool holder (21) of the workpiece spindle (20) takes place by moving the workpiece spindle (20) along the X-axis.

12. The method according to claim 7, further comprising:

gripping the tool holder with a gripper (52), releasing a spindle clamp, lifting the tool (41) by moving the tool (41) parallel to a BY-axis, the BY-axis extending parallel to an axis of the tool spindle (40), rotating a tool changer (50) about the BY-axis to a position of a new tool, inserting the new tool by moving the new tool parallel to the BY-axis, tightening the spindle clamp about the new tool, and opening the gripper (52).

* * * * *